US005674822A

United States Patent [19]

Schlosberg et al.

[11] Patent Number: 5,674,822

[45] Date of Patent: Oct. 7, 1997

[54] SYNTHETIC ESTER BASE STOCKS FOR LOW EMISSION LUBRICANTS

[75] Inventors: Richard Henry Schlosberg, Bridgewater; Walter Weissman, Berkeley Heights, both of N.J.; Maciej Radosz, Baton Rouge, La.; Gerald Dennis Dupre', Flemington, N.J.; Ralph Donald Gray, Jr., Morristown, N.J.; John Eric Johnston, Warren, N.J.; Patrick Edward Godici, Millington, N.J.; Richard Samuel Polizzotti, Milford, N.J.; Lawrence Harold Kaplan, Clinton, N.J.

[73] Assignee: Exxon Chemical Patents Inc, Houston, Tex.

[21] Appl. No.: 531,766

[22] Filed: Sep. 21, 1995

[51] Int. Cl.[6] ..... C10M 105/38

[52] U.S. Cl. ..... 508/485; 508/492; 508/495

[58] Field of Search ..... 508/485, 492, 508/495

[56] References Cited

U.S. PATENT DOCUMENTS

| | | | |
|---|---|---|---|
| 3,441,600 | 4/1969 | Chao et al. | 508/485 |
| 3,694,382 | 9/1972 | Kleiman et al. . | |
| 4,113,642 | 9/1978 | Koch et al. . | |
| 4,175,046 | 11/1979 | Coant et al. . | |
| 4,175,047 | 11/1979 | Schick et al. . | |
| 4,820,431 | 4/1989 | Kennedy | 508/485 |
| 5,021,179 | 6/1991 | Zehler et al. | 508/485 |
| 5,374,303 | 12/1994 | Van Hoorn | 106/38.22 |
| 5,458,794 | 10/1995 | Barclasz et al. | 508/485 |
| 5,494,597 | 2/1996 | Krevales, Jr. et al. | 508/485 |
| 5,503,761 | 4/1996 | Ashcroft, Jr. et al. | 508/485 |

FOREIGN PATENT DOCUMENTS

| | | |
|---|---|---|
| A-413315 | 2/1991 | European Pat. Off. . |
| 0571091 | 11/1993 | European Pat. Off. . |
| A-612832 | 8/1994 | European Pat. Off. . |
| A-64638 | 4/1995 | European Pat. Off. . |
| A-1158386 | 7/1969 | United Kingdom . |
| A-1264897 | 2/1972 | United Kingdom . |

OTHER PUBLICATIONS

Gatellier et al., "Hydrocarbon Emissions of SI Engines as Influenced by Fuel Absorption–Desorption in Oil Films", Society of Automotive Engineers, Inc., Abstract No. 920095 Date unavailable.

Shih and Assanis, "Modelling Unburned Hydrocarbon Formation due to Absorption/Desorption Processes into the Wall Oil Film", American Chemical Society, (Aug. 23–28, 1992), p. 1496.

Trinker et al., "The Effect of Fuel–Oil Solubility on Exhaust HC Emissions", Society of Automotive Engineers, Inc., Abstract No. 912349. Date unavailable.

Schramm and Sorenson, "A Model for Hydrocarbon Emissions from SI Engines", Society of Automotive Engineers, Inc., Abstract No. 902169. Date unavailable.

Schramm and Sorenson, "Effects of Lubricating Oil on Hydrocarbon Emissions in an SI Engine", Society of Automotive Engineers, Inc., Abstract No. 890622. Date unavailable.

Ishizawa and Takagi, "A Study of HC Emission from a Spark Ignition Engine", Nissan Motor Co., Ltd. (1986), p. 310. Month unavailable.

Schramm and Sorenson, "Solubility of Gasoline Components in Different Lubricants for Combustion Engines Determined by Gas–Liquid Partition Chromatography", Journal of Chromatography, 538 (1991) pp. 241–248. Month unavailable.

*Primary Examiner*—Jacqueline V. Howard
*Attorney, Agent, or Firm*—Richard D. Jordan

[57] ABSTRACT

A low emissions, high oxidative stability crankcase lubricating oil formulation which is prepared from a base stock which comprises at least one synthetic ester selected from the group consisting of: polyol esters, synthetic esters having between 5–35% unconverted hydroxyl groups, based on the total amount of hydroxyl groups in the polyol, and synthetic esters combined with at least one additional functional group which is capable of increasing the polarity of the functionalized synthetic ester, wherein the base stock has an oxygen, nitrogen or halogen content of at least 15 wt. %, based on the total weight of the base stock; and a lubricant additive package.

8 Claims, No Drawings

SYNTHETIC ESTER BASE STOCKS FOR LOW EMISSION LUBRICANTS

The present invention relates generally to a family of unique highly polarized synthetic esters for use in crankcase lubricating oils or other systems where hydrocarbon fuel and lubricant emissions suppression (i.e., reduction), and a high degree of resistance to oxidative attack is desired. In particular, the lubricating oil comprises a family of unique synthetic ester base stocks which are sufficiently polar to ensure that hydrocarbon fuel components are only minimally soluble in the lubricating oil, thereby reducing the amount of fuel which can be trapped in oil film at engine shutdown and exhausted from an engine together with the lubricant, especially during engine start-up.

BACKGROUND OF THE INVENTION

Over the past 10 to 15 years there has been a concerted effort by both engine manufacturers and petroleum suppliers to alleviate environmental concerns over engine exhaust emissions by substantially reducing the amount of hydrocarbon contained in such emissions. In recent years, attention has been turned to the effect which certain engine lubricants have in reducing hydrocarbon emissions.

Recent studies have focused on the various potential hydrocarbon emission sources, e.g., engine crevices, oil layer, deposits, incomplete combustion and liquid fuel in engine cylinders. Each of these sources can produce a layer of hydrocarbons on the cylinder surface. In an article by J. Schramm and S. C. Sorenson, Journal of Chromatography, Vol. 538, pp. 1241 (1991), it was suggested that solubility characteristics of the lubricant influences the absorption of fuel molecules into the lubricant. The fuel molecules absorbed within the lubricant are then released together with other engine exhaust emissions.

Lubricants in commercial use today are prepared from a variety of natural and/or synthetic base stocks admixed with various additive packages and solvents depending upon their intended application. Typical base stocks include mineral oils, highly refined mineral oils, poly alpha olefins (PAO), polyalkylene glycols (PAG), phosphate esters, silicone oils, diesters and polyol esters.

The present inventors have discovered that a select group of synthetic ester base stocks are able to reduce the amount of hydrocarbons exhausted together with the emissions from crankcase engines or other engines where fuel and lubricant emission suppression is desirable. The synthetic ester base stocks are those which form highly polarized lubricants in which fuel components are only minimally soluble, thereby reducing the amount of fuel which is dissolved and/or dispersed within the lubricant, thereby leading to a reduction of hydrocarbons in the exhaust gas.

The present inventors have also discovered that if the fuel is only minimally soluble within the lubricant, then a reduced amount of fuel is available for depositing within engine crevices or on the engine cylinder surface.

These highly polar synthetic ester base stocks result in lesser amounts of hydrocarbon being trapped within the lubricating oil film during the compression stroke. Therefore, after combustion there will be less adsorbed hydrocarbon available for discharge out the exhaust system prior to catalyst heat-up, thereby reducing the overall mount of hydrocarbon emission from a respective engine. Since there are less light hydrocarbons dissolved within the lubricating oil due to the high polarity thereof, the lubricating oil composition itself will be less volatile which will also reduce the amount of lubricant exhausted from the engine as emissions.

In particular, the present inventors have discovered that highly polarized synthetic ester lubricant base stocks having unreacted hydroxyl groups and an overall oxygen content of 15 wt. % or greater are capable of suppressing fuel (e.g., paraffin, olefin and aromatic hydrocarbons) and lubricant emissions from crankcase engines due to the fact that the fuel is only minimally soluble within the lubricant base stock.

Contrary to current theories which believe that hydroxyl groups lower the oxidative stability of the resultant lubricant, the present inventors have also discovered that a select group of synthetic esters having a strongly polar end group such as a hydroxyl group on the ester's carbon chain not only reduces the fuel solubility in the lubricant, but are thermally and oxidatively stable molecules which increase the number of drain intervals required over a set period of time, and decrease inlet valve deposit formation and combustion chamber deposit formation.

The present inventors have also determined that synthetic esters which are combined with at least one additional functional group that is capable of increasing the polarity of the functionalized synthetic ester and wherein the synthetic ester has an oxygen, nitrogen and/or halogen content of at least 15 wt. %, based on the total weight of the synthetic ester, are also capable of suppressing fuel and lubricant emissions.

Still further, the present inventors have discovered that polyol esters which have an oxygen, nitrogen and/or halogen content of at least 15 wt. %, based on the total weight of the polyol ester, are also capable of suppressing fuel and lubricant emission.

The present invention also provides many additional advantages which shall become apparent as described below.

SUMMARY OF THE INVENTION

A low emissions lubricant for hydrocarbon engine operation which comprises a base stock that is capable of increasing the polarity of the lubricant such that hydrocarbon fuel is only minimally soluble therein. The lubricant preferably includes a lubricant additive package which is suitable for its intended use.

Preferably, the low emissions lubricant for use with hydrocarbon fuels according to the present invention includes a base stock which comprises at least one synthetic ester selected from the group consisting of: (1) polyol esters having an oxygen, nitrogen or halogen content of at least 15 wt. %, based on the total weight of the base stock; (2) synthetic esters having between 5–50% unconverted hydroxyl groups, based on the total amount of hydroxyl groups in the polyol, and an oxygen, nitrogen or halogen content of at least 15 wt. %, based on the total weight of the base stock; and (3) synthetic esters combined with at least one additional functional group which is capable of further increasing the polarity of the functionalized synthetic ester and having an oxygen, nitrogen or halogen content of at least 15 wt. %, based on the total weight of the base stock.

One particularly preferred synthetic ester is an ester having between 5–50% unconverted hydroxyl groups which is formed from the reaction product of: a branched or linear alcohol having the general formula $R(OH)_n$, wherein R is an aliphatic or cyclo-aliphatic group having from about 2 to 20 carbon atoms and n is at least 2, and at least one branched mono-carboxylic acid which has a carbon number in the range between about $C_5$ to $C_{13}$; wherein the synthetic ester composition has between 5–50% unconverted hydroxyl groups, based on the total amount of hydroxyl groups in the branched or linear alcohol.

Functional groups which are capable of increasing the polarity of the synthetic ester include ketones, aromatics, halogens, hydroxyl, acids, amides, ethers, alcohols, olefinic groups, etc.

The low emissions lubricant formed using the particular synthetic ester base stocks of the present invention exhibit the following properties: (1) a solubility of the hydrocarbon fuels in the lubricant of less than 5% at 1 bar; (2) a base stock having a metals content of less than 10 ppm; and (3) a base stock having a total acid number of less than 0.05 milligrams KOH per gram of the base stock.

When used as a crankcase lubricating oil the synthetic ester base stock is preferably admixed with a lubricant additive package which comprises at least one additive selected from the group consisting of: ashless dispersants, metal detergents, corrosion inhibitors, metal dihydrocarbyl dithiophosphates, anti-oxidants, pour point depressants, anti-foaming agents, anti-wear agents, friction modifiers, and viscosity modifiers. Typically, in an mount of about 80–99% by weight of the base stock and about 1 to 20% by weight the additive package.

It is preferable to admix selected viscosity index additives with the base stocks of the present invention to improve the viscosity index, while maintaining the limited solubility of the base stock in hydrocarbon fuels. It is also conceivable that dispersive additives can be admixed with synthetic ester base stocks having unconverted hydroxyl groups in order to localize the resulting lubricant, i.e., at the fuel-air/lube and fuel-wall/lube interfaces.

Still other lubricants can be formed by blending the unique synthetic ester base stocks of the present invention with at least one additional base stock selected from the group consisting of: mineral oils, highly refined mineral oils, poly alpha olefins, polybutenes, polyalkylene glycols, phosphate esters, silicone oils, diesters, polyisobutylenes, ethylene and butene copolymers, and other polyol esters.

DESCRIPTION OF THE PREFERRED EMBODIMENTS

The present invention provides a method for substantially reducing or eliminating the amount of hydrocarbon layer absorbed on the various surfaces of a passenger car gas or diesel engine, i.e., engine crevices or cylinder surfaces. The reduction in hydrocarbon and carbon monoxide emissions from such engines is accomplished by forming a crankcase engine lubricant from a base stock which comprises a highly polar synthetic ester having an oxygen, nitrogen or halogen content of 15 wt. % or greater, whereby the hydrocarbon component is only minimally soluble within the lubricant film disposed on the various surfaces of a passenger car gas or diesel engine, i.e., engine crevices or cylinder surfaces.

The synthetic ester base stock according to the present invention can include any (1) polyol ester having an oxygen, nitrogen or halogen content of at least 15 wt. %, based on the total weight of the base stock; (2) synthetic ester having between 5–50% unconverted hydroxyl groups, based on the total amount of hydroxyl groups in the polyol and an oxygen, nitrogen or halogen content of at least 15 wt. %, based on the total weight of the base stock; and (3) synthetic ester combined with at least one additional functional group which is capable of further increasing the polarity of the functionalized synthetic ester and an oxygen, nitrogen or halogen content of at least 15 wt. %, based on the total weight of the base stock. Each of the above listed synthetic ester base stocks provide low solubility for hydrocarbon species, e.g., paraffins, olefins or aromatics. It is of particular importance that any of the selected synthetic ester base stocks which are used to form a low emissions lubricant exhibit a high degree of polarity with respect to the hydrocarbon fuels.

The low emissions lubricant formed using the particular synthetic ester base stocks of the present invention exhibit the following properties: (1) a solubility of the hydrocarbon fuels in the lubricant of less than 5% at 1 bar; (2) a base stock having a metals content of less than 10 ppm; and (3) a base stock having a total acid number of less than 0.05 milligrams KOH per gram of the base stock.

Highly polar synthetic polyol esters are typically formed by reacting a polyhydric alcohol with either a branch acid, linear acid or mixture thereof. The esterification reaction is preferably conducted, with or without a catalyst, at a temperature in the range between about 140° to 250° C. and a pressure in the range between about 30 mm Hg to 760 mm Hg (3.999 to 101.308 kPa) for about 0.1 to 12 hours, preferably 2 to 8 hours. The stoichiometry in the reactor is variable, with the capability of vacuum stripping excess reagent to generate the preferred final composition.

If the esterification reaction is conducted under catalytic conditions, then the preferred esterification catalysts are titanium, zirconium and tin catalysts such as titanium, zirconium and tin alcoholates, carboxylates and chelates. Selected acid catalysts may also be used in this esterification process. See U.S. Pat. Nos. 5,324,853 (Jones et at.), which issued on Jun. 28, 1994, and U.S. Pat. No. 3,056,818 (Werber), which issued on Oct. 2, 1962, both of which are incorporated herein by reference.

ALCOHOLS

Among the alcohols which can be reacted with either the branched acid or branched and linear acid mixture are, by way of example, polyols (i.e., polyhydroxyl compounds) represented by the general formula:

$$R(OH)_n$$

wherein R is any aliphatic or cyclo-aliphatic hydrocarbyl group (preferably an alkyl) and n is at least 2. The hydrocarbyl group may contain from about 2 to about 20 or more carbon atoms, and the hydrocarbyl group may also contain substituents such as chlorine, nitrogen and/or oxygen atoms. The polyhydroxyl compounds generally may contain one or more oxyalkylene groups and, thus, the polyhydroxyl compounds include compounds such as polyetherpolyols. The number of carbon atoms (i.e., carbon number, wherein the term carbon number as used throughout this application refers to the total number of carbon atoms in either the acid or alcohol as the case may be) and number of hydroxy groups (i.e., hydroxyl number) contained in the polyhydroxyl compound used to form the carboxylic esters may vary over a wide range.

The following alcohols are particularly useful as polyols: neopentyl glycol, 2,2-dimethylol butane, trimethylol ethane, trimethylol propane, trimethylol butane, monopentaerythritol, technical grade pentaerythritol, di-pentaerythritol, tri-pentaerythritol, ethylene glycol, propylene glycol and polyalkylene glycols (e.g., polyethylene glycols, polypropylene glycols, 1,4-butanediol, sorbitol and the like, 2-methylpropanediol, polybutylene glycols, etc., and blends thereof such as a polymerized mixture of ethylene glycol and propylene glycol). The most preferred alcohols are technical grade (e.g., approximately 88% mono-, 10% di- and 1–2% tri-pentaerythritol) pentaerythritol, monopentaerythritol, di-pentaerythritol, neopentyl glycol, trimethylol propane, and 1,4-butanediol.

Any other alcohols suitable for making synthetic ester base stocks having the properties described above are also contemplated hereunder. See U.S. Pat. No. 5,324,853 (Jones et at.), which issued on Jun. 28, 1994, for a partial listing of other such alcohols.

ACIDS

Carboxylic acids which undergo esterification can be aliphatic, cycloaliphatic or aromatic, they can be substituted or unsubstituted, saturated or unsaturated, linear or branched, or they can be blends of acids. Among the preferred branched acids are mono-carboxylic acids which have a carbon number in the range between about $C_5$ to $C_{13}$, more preferably about $C_6$ to $C_{10}$. The monocarboxylic acid is preferably at least one acid selected from the group consisting of: 2,2-dimethyl propionic acid (neopentanoic acid), neoheptanoic acid, neooctanoic acid, neononanoic acid; neodecanoic acid, 2-methyl pentanoic acid, 2-ethyl hexanoic acid (2EH), 3,5,5-trimethyl hexanoic acid (TMH), isoheptanoic acid, isooctanoic acid, isononanoic acid and isodecanoic acid. One especially preferred branched acid is 3,5,5-trimethyl hexanoic acid. The term "neo" as used herein refers to a trialkyl acetic acid, i.e., an acid which is triply substituted at the alpha carbon with alkyl groups. These alkyl groups are equal to or greater than $CH_3$ as shown in the general structure set forth herebelow:

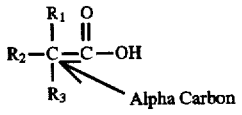

wherein $R_1$, $R_2$, and $R_3$ are greater than or equal to $CH_3$ and not equal to hydrogen.

3,5,5-trimethyl hexanoic acid has the structure set forth herebelow:

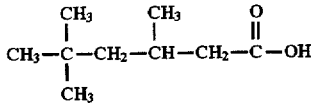

The preferred mono- and/or di-carboxylic linear acids are any linear saturated alkyl carboxylic acid having a carbon number in the range between about $C_2$ to $C_{18}$, preferably $C_2$ to $C_{10}$. Some examples of linear acids include acetic, propionic, pentanoic, heptanoic, octanoic, nonanoic, and decanoic acids. Selected diacids include any $C_2$ to $C_{12}$ diacids, e.g., adipic, azelaic, sebacic and dodecanedioic acids. A partial listing of acids used in the esterification process are set forth in U.S. Pat. No. 5,324,853 (Jones et al.), which issued on Jun. 28, 1994, and which is incorporated herein.

A preferred highly polar synthetic ester composition of the present invention is one which contains unconverted hydroxyl groups. Such an ester is typically formed by reacting a polyhydroxyl compound with at least one branched acid. In the polyol ester composition, the polyol is preferably present in an excess of about 5 to 35 equivalent percent or more for the amount of acid used. The composition of the feed polyol is adjusted so as to provide the desired composition of the product ester. See U.S. patent application, Ser. No. 08/403,366 (Schlosberg et al.) which was filed on Mar. 14, 1995, and which is incorporated herein by reference.

Alternatively, linear acids can be admixed with the branched acids in a ratio of between about 1:99 to 80:20 and thereafter reacted with the branched or linear alcohol as set forth immediately above. However, the same molar excess of alcohol used in the all branched case is also required in the mixed acids case such that the synthetic ester composition formed by reacting the alcohol and the mixed acids still has between about 5–35% unconverted hydroxyl groups, based on the total amount of hydroxyl groups in the alcohol.

The process of synthesizing polyol ester compositions having significant unconverted hydroxyl groups according to the present invention typically follows the equation below:

$$R(OH)_n+R'COOH \rightarrow R(OH)_n+R(OOCR')_n+R(OOCR')_{n-1}OH+R(OOCR')_{n-2}(OH)_2+R(OOCR')_{n-i}(OH)_i \quad \text{(Eq. 1)}$$

wherein n is an integer having a value of at least 2, R is any aliphatic or cycloaliphatic hydrocarbyl group containing from about 2 to about 20 or more carbon atoms and, optionally, substituents such as chlorine, nitrogen and/or oxygen atoms, and R' is any branched aliphatic hydrocarbyl group having a carbon number in the range between about $C_4$to $C_{12}$, more preferably about $C_6$ to $C_9$, wherein methyl or ethyl branches are preferred, and (i) is an integer having a value of between about 0 to n.

The reaction product also comprises at least one linear acid. This linear acid being present in an amount of between about 1 to 80 wt. % based on the total amount of the branched mono-carboxylic acid. The linear acid is any linear saturated alkyl carboxylic acid having a carbon number in the range between about $C_2$ to $C_{12}$.

Selected synthetic esters having between 5–35% unconverted hydroxyl groups exhibit between about 20 to 200% higher thermal/oxidative stability as measured by high pressure differential scanning calorimetry versus a fully esterified composition formed from the branched or linear alcohol and the branched mono-carboxylic acid which have less than 10% unconverted hydroxyl groups, based on the total amount of hydroxyl groups in the branched or linear alcohol. These synthetic ester compositions have a hydroxyl number which is at least 20 milligrams of KOH per gram of sample.

The preferred branched acids used to make synthetic esters having between 5–35% unconverted hydroxyl groups are any mono-carboxylic acid which have a carbon number in the range between about $C_5$ to $C_{10}$. For example, 2,2-dimethyl propionic acid, neoheptanoic acid, neooctanoic acid, neononanoic acid, neodecanoic acid, 2-methyl pentanoic acid, 2-ethyl hexanoic acid, 3,5,5-trimethyl hexanoic acid, isoheptanoic acid, isooctanoic acid, isononanoic acid and isodecanoic acid.

The preferred linear acids are any linear saturated alkyl carboxylic acid having a carbon number in the range between about $C_2$ to $C_7$. For example, acetic acid, propionic acid, pentanoic acid, heptanoic acid, octanoic acid, nonanoic acid, and decanoic acid. Alternatively, the linear acid can be a diacid, e.g., adipic acid, azelaic acid, sebacic acid and dodecanedioic acid.

The preferred branched or linear alcohols are selected from the group consisting of: neopentyl glycol, 2,2-dimethylol butane, trimethylol ethane, trimethylol propane, trimethylol butane, mono-pentaerythritol, technical grade pentaerythritol, di-pentaerythritol, tri-pentaerythritol, ethylene glycol, propylene glycol, polyalkylene glycols, 1,4-butanediol, sorbitol, and 2-methylpropanediol.

Additionally, synthetic esters that are combined with additional functional groups such as ketones, aromatics, halogens, hydroxyl, esters, acids, amides, ethers, alcohols, olefinic groups, etc. to provide increased polarity and low solubility for hydrocarbon species are also contemplated by the present invention.

The synthetic ester base stocks according to the present invention can be used in the formulation of various lubricants, such as, crankcase engine oils (i.e., passenger car motor oils, heavy duty diesel motor oils, and passenger car diesel oils) and other engine lubrication applications. The lubricating oils contemplated for use with the synthetic ester base stocks of the present invention include both synthetic hydrocarbon oils of lubricating viscosity and blends thereof with at least one additional base stock selected from the group consisting of: mineral oils, highly refined mineral oils, poly alpha olefins, polyalkylene glycols, phosphate esters, silicone oils, diesters, polyisobutylenes and other polyol esters. The synthetic hydrocarbon oils include long chain alkanes such as cetanes and olefin polymers such as oligomers of isobutylene, hexene, octene, decene, dodecene, and copolymers of ethylene and butene, etc. Still other synthetic oils include (1) fully esterified ester oils, with no free hydroxyls, such as pentaerythritol esters of monocarboxylic acids having 2 to 20 carbon atoms, trimethylol propane esters of monocarboxylic acids having 2 to 20 carbon atoms, (2) polyacetals and (3) siloxane fluids. Especially useful among the synthetic esters are those made from polycarboxylic acids and monohydric alcohols. More preferred are the ester fluids made by fully esterifying pentaerythritol, or mixtures thereof with di- and tri-pentaerythritol, with an aliphatic monocarboxylic acid containing from 1 to 20 carbon atoms, or mixtures of such acids.

The formulated lubricant according to the present invention preferably comprises about 80–99% by weight of at least one polyol ester composition of the present invention, about 1 to 20% by weight lubricant additive package.

CRANKCASE LUBRICATING OILS

Synthetic ester base stocks having an oxygen, nitrogen or halogen (e.g., fluorine, chlorine or bromine) content of at least 15 wt. %, based on the total weight of the base stock, can be used in the formulation of crankcase lubricating oils (i.e., passenger car motor oils, heavy duty diesel motor oils, and passenger car diesel oils) for spark-ignited and compression-ignited engines. The additives listed below are typically used in such amounts so as to provide their normal attendant functions. Typical amounts for individual components are also set forth below. All the values listed are stated as mass percent active ingredient.

| ADDITIVE | MASS % (Broad) | MASS % (Preferred) |
|---|---|---|
| Ashless Dispersant | 0.1–20 | 1–8 |
| Metal detergents | 0.1–15 | 0.2–9 |
| Corrosion Inhibitor | 0–5 | 0–1.5 |
| Metal dihydrocarbyl dithiophosphate | 0.1–6 | 0.1–4 |
| Supplemental anti-oxidant | 0–5 | 0.01–1.5 |
| Pour Point Depressant | 0.01–5 | 0.01–1.5 |
| Anti-Foaming Agent | 0–5 | 0.001–0.15 |
| Supplemental Anti-wear Agents | 0–0.5 | 0–0.2 |
| Friction Modifier | 0–5 | 0–1.5 |
| Viscosity Modifier | 0.01–6 | 0–4 |
| Synthetic Ester Base stock | Balance | Balance |

The individual additives may be incorporated into a base stock in any convenient way. Thus, each of the components can be added directly to the base stock by dispersing or dissolving it in the base stock at the desired level of concentration. Such blending may occur at ambient temperature or at an elevated temperature.

Preferably, all the additives except for the viscosity modifier and the pour point depressant are blended into a concentrate or additive package described herein as the additive package, that is subsequently blended into base stock to make finished lubricant. Use of such concentrates is conventional. The concentrate will typically be formulated to contain the additive(s) in proper amounts to provide the desired concentration in the final formulation when the concentrate is combined with a predetermined amount of base lubricant.

The concentrate is preferably made in accordance with the method described in U.S. Pat. No. 4,938,880, which is incorporated herein by reference. That patent describes making a pre-mix of ashless dispersant and metal detergents that is pre-blended at a temperature of at least about 100° C. Thereafter, the pre-mix is cooled to at least 85° C. and the additional components are added.

The final crankcase lubricating oil formulation may employ from 2 to 15 mass % and preferably 5 to 10 mass %, typically about 7 to 8 mass % of the concentrate or additive package with the remainder being base stock.

The ashless dispersant comprises an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersant may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

The viscosity modifier (VM) functions to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Metal-containing or ash-forming detergents function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. The salts may contain a substantially stoichiometric amount of the metal in which case they are usually described as normal or neutral salts, and would typically have a total base number or TBN (as may be measured by ASTM D2896) of from 0 to 80. It is possible to include large amounts of a metal base by reacting an excess of a metal compound such as an oxide or hydroxide with an acidic gas such as carbon dioxide. The resulting overbased detergent comprises neutralized detergent as the outer layer of a metal base (e.g. carbonate) micelle. Such overbased detergents may have a TBN of 150 or greater, and typically of from 250 to 450 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from 20 to 450 TBN, and neutral and overbased calcium phenates and sulfurized phenates having TBN of from 50 to 450.

Dihydrocarbyl dithiophosphate metal salts are frequently used as anti-wear and antioxidant agents. The metal may be an alkali or alkaline earth metal, or aluminum, lead, tin, molybdenum, manganese, nickel or copper. The zinc salts are most commonly used in lubricating oil in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt any basic or neutral zinc compound could be used but the oxides, hydroxides and carbonates are most generally employed. Commercial additives frequently contain an excess of zinc due to use of an excess of the basic zinc compound in the neutralization reaction.

Oxidation inhibitors or antioxidants reduce the tendency of base stocks to deteriorate in service which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, phosphorous esters, metal thiocarbamates, oil soluble copper compounds as described in U.S. Pat. No. 4,867,890, and molybdenum containing compounds.

Friction modifiers may be included to improve fuel economy. Oil-soluble alkoxylated mono- and diamines are well known to improve boundary layer lubrication. The amines may be used as such or in the form of an adduct or reaction product with a boron compound such as a boric oxide, boron halide, metaborate, boric acid or a mono-, di- or trialkyl borate.

Other friction modifiers are known. Among these are esters formed by reacting carboxylic acids and anhydrides with alkanols. Other conventional friction modifiers generally consist of a polar terminal group (e.g. carboxyl or hydroxyl) covalently bonded to an oleophillic hydrocarbon chain. Esters of carboxylic acids and anhydrides with alkanols are described in U.S. Pat. No. 4,702,850. Examples of other conventional friction modifiers are described by M. Belzer in the "Journal of Tribology" (1992), Vol. 114, pp. 675–682 and M. Belzer and S. Jahanmir in "Lubrication Science" (1988), Vol. 1, pp. 3–26.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK. Patent Specification No. 1,560,830. Benzotriazoles derivatives also fall within this class of additives. When these compounds are included in the lubricating composition, they are preferably present in an amount not exceeding 0.2 wt % active ingredient.

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers and polyalkylmethacrylates.

Foam control can be provided by many compounds including an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and does not require further elaboration.

EXAMPLE 1

For comparative purposes, Table 1 below demonstrates the Federal Test Procedure (FTP) emissions reduction for hydrocarbon (HC), i.e., −3.9%, and carbon monoxide (CO), i.e., −6.0%, when a synthetic polyol ester having an oxygen content of 20 wt. %, based on the total weight of the base stock (i.e., the lo polyol ester is formed from the reaction product of pentaerythritol and an oxooctanoic acid, i.e., a mixture of branched $C_8$ acids which are formed from the hydroformylation of a mixture of $C_7$ olefins) is compared against a mineral oil base stock of similar kinematic viscosity, typical of that contained in an SAE 30 grade motor oil.

TABLE 1

| | % Difference in FTP Emissions Polyol Ester vs. Mineral Oil | Significant Level [%] |
|---|---|---|
| HC | −3.9 | (85) |
| CO | −6.0 | (78) |
| $NO_x$ | +6.4 | (85) |

EXAMPLE 2

The data set forth below in Table 2 support the proposition that solubilities in highly polar lubricants such as those covered by the present invention are reduced versus that in mineral oil lubricants. The solubility of the various lubricants was obtained at 150° C. by gas chromatography.

TABLE 2

| | | Wt. % at 1 bar | | |
|---|---|---|---|---|
| Lubricant | Molecular Wt. | $nC_{10}H_{22}$ | p-Xylene | MTBE |
| Mineral Oil* | 385 | 7.9 | 3.0 | 0.3 |
| TPE—$BrC_9/C_8$** | ca. 707 | 4.3 | 2.4 | 0.3 |
| PPG*** | 1000 | 3.5 | 2.5 | 0.3 |

*The Mineral Oil is a low sulfur, neutralized, saturated, linear hydrocarbon mineral oil having between 14 to 34 carbon atoms. (less than 3 wt. % oxygen, nitrogen and/or halogen content).
**TPE—$BrC_9/C_8$ is a technical grade pentaerythritol ester of ca. 75% $BrC_9$(3,5,5-trimethyl hexanoic acid) and ca. 25% $BrC_8$ (oxooctanoic acid). (18.8 wt. % oxygen, nitrogen and/or halogen content).
***PPG is polypropylene glycol. (27.8 wt. % oxygen, nitrogen and/or halogen content).

When normalized, i.e., adjusted by assuming a Flory Huggins relationship could be applied, to comparable molecular weights, there still is benefit seen for the highly polar lubricants verses conventional mineral oil-based lubricants as shown in Table 3 below.

TABLE 3

| | Calc. for Mol. | Wt. % at 1 bar | | |
|---|---|---|---|---|
| Lubricant | Wt. = Min. Oil | $nC_{10}H_{22}$ | p-Xylene | MTBE |
| Mineral Oil* | 385 | 7.9 | 3.0 | 0.3 |
| TPE-$BrC_9/C_8$** | 385 | 5.3 | 3.0 | 0.3 |
| PPG*** | 385 | 4.8 | 3.4 | 0.3 |

*The Mineral Oil is a low sulfur, neutralized, saturated, linear hydrocarbon mineral oil having between 14 to 34 carbon atoms (less than 3 wt. % oxygen, nitrogen and/or halogen content).
**TPE-$BrC_9/C_8$ is a technical grade pentaerythritol ester of ca. 75% $BrC_9$ (3,5,5-trimethyl hexanoic acid) and ca. 25% $BrC_8$(oxooctanoic acid) (18.8 wt. % oxygen, nitrogen and/or halogen content).
***PPG is polypropylene glycol (27.8 wt. % oxygen, nitrogen and/or halogen content).

This example demonstrates that the more polar the lubricant, the less solubility the lubricant is in the hydrocarbon fuel which results in a reduction in the amount of fuel which is exhausted from a crankcase engine together with the lubricant.

EXAMPLE 3

Solubility data for gasoline components in alternative lubricants at 150° C. by gas chromatography is set forth below in Table 4 wherein a deliberately highly polar comparative base stock showed further reduction in fuel solubility.

TABLE 4

| | | Wt. % at 1 bar | | |
|---|---|---|---|---|
| Lubricant | Molecular Wt. | $nC_{10}H_{22}$ | p-Xylene | MTBE |
| Mineral Oil* | 385 | 7.9 | 3.0 | 0.3 |
| TPE-$BrC_9/C_8$** | ca. 707 | 4.3 | 2.4 | 0.3 |
| TPE-$BrC_9$ w/unconverted OH*** | 500 | 3.7 | 2.4 | 0.3 |

*The Mineral Oil is a low sulfur, neutralized, saturated, linear hydrocarbon mineral oil having between 14 to 34 carbon atoms. (less than 3 wt.% oxygen, nitrogen and/or halogen content).
**TPE-$BrC_9/C_8$ is a technical grade pentaerythritol ester of ca. 75% $BrC_9$ (3,5,5-trimethyl hexanoic acid) and ca. 25% $BrC_8$ (oxooctanoic acid). (18.8 wt. % oxygen, nitrogen and/or halogen content).
***TPE-$BrC_9$ with unconverted OH is a technical grade pentaerythritol ester of ca. 100% $BrC_9$ (3,5,5-trimethyl hexanoic acid) having 30% unconverted hydroxy groups disposed about the carbon chain of the ester. (20.1 wt. % oxygen, nitrogen and/or halogen content).

When normalized (i.e., adjusted by assuming a Flory Huggins relationship could be applied) to comparable molecular weights, there is benefit seen for the polar synthetic ester lubricants versus conventional ester- and mineral oil-based lubricants as shown in Table 5 below.

TABLE 5

| | | Wt. % at 1 bar | | |
|---|---|---|---|---|
| Lubricant | Molecular Wt. | $nC_{10}H_{22}$ | p-Xylene | MTBE |
| Mineral Oil* | 385 | 7.9 | 3.0 | 0.3 |
| TPE $BrC_9/C_8$** | 385 | 5.3 | 3.0 | 0.3 |
| TPE-$BrC_9$ w/unconverted OH*** | 385 | 4.1 | 2.7 | 0.3 |

*The Mineral Oil is a low sulfur, neutralized, saturated, linear hydrocarbon mineral oil having between 14 to 34 carbon atoms. (less than 3 wt.% oxygen, nitrogen and/or halogen content).
**TPE-$BrC_9/C_8$ is a technical grade pentaerythritol ester of ca. 75% $BrC_9$ (3,5,5-trimethyl hexanoic acid) and ca. 25% $BrC_8$ (oxooctanoic acid). (18.8 wt. % oxygen, nitrogen and/or halogen content).
***TPE-$BrC_9$ with unconverted OH is a technical grade pentaerythritol ester of ca. 100% $BrC_9$ (3,5,5-trimethyl hexanoic acid) having 30% unconverted hydroxy groups disposed about the carbon chain of the ester. (20.1 wt. % oxygen, nitrogen and/or halogen content).

The above examples demonstrate that the lubricant composition has a drastic effect on the hydrocarbon fuel solubility in the lubricant and in subsequent engine emission hydrocarbon levels. Furthermore, these examples demonstrate that highly polar polyol ester lubricants (i.e., those containing sufficiently high (15 wt. % or greater) oxygen, nitrogen and/or halogen content) have reduced capability for solubilizing paraffin and aromatic fuel components, thus reducing hydrocarbon exhaust emissions from a crankcase engine. The examples further demonstrate that a strongly polar end group such as an unconverted hydroxyl group on the lubricant further reduces the fuel solubility in the lubricant.

It is also extremely desirable in crankcase lubricant applications to provide a lubricant product which is thermally/oxidatively stable. One means of measuring relative thermal/oxidative stability in lubricants is via high pressure differential scanning calorimetry (HPDSC). In this test, the sample is heated to a fixed temperature and held there under a pressure of air (or oxygen) and the time to onset of decomposition is measured. The longer the time to decomposition, the more stable the sample. In all cases described hereafter, the conditions are as follows unless specifically noted otherwise: 220° C., 3.445 MPa (500 psi) air (i.e., 0.689 MPa (100 psi) oxygen and 2.756 MPa (400 psi) nitrogen), and the addition of 0.5 wt. % dioctyl diphenyl amine (Vanlube-S1®) as an antioxidant.

EXAMPLE 4

The data set forth below in Table 6 indicate that there is considerable room for improving the thermal/oxidative performance of polyol esters as measured by the HPDSC test. In particular, it should be noted that esters of 3,5,5-trimethyl hexanoic acid and 2,2-dimethylpropionic acid (i.e., neopentanoic (neo-$_{C5}$)) are particularly stable under the HPDSC test.

TABLE 6

| Sample Number | Ester | HPDSC Decomposition Time, Min. |
|---|---|---|
| 1 | TMP/n-$C_9$ | 14.2 |
| 2 | TechPE/n-$C_9$ | 14.7 |
| 3 | TMP/TMH | 119 |
| 4 | TechPE/TMH | 148 |
| 5 | MPE/TMH | 143 |
| 6 | TMP/n-$C_5$ | 51.9 |
| 7 | 50% TMP/TMH and 50% TMP/n-$C_5$ | 65.7 |
| 8 | MPE/TMH/neo-$C_5$ | 168 |

n-$C_9$ is a linear normal $C_9$ acid.
TechPE is technical grade pentaerythritol (i.e., 88% mono-, 10% di- and 1–2% tri-pentaerythritol).
MPE is mono-pentaerythritol.
n-$C_5$ is a linear normal $C_5$ acid.
TMH is 3,5,5-trimethyl hexanoic acid.
neo-$C_5$ is 2,2-dimethyl propionic acid.

A polyol ester having unconverted hydroxyl groups disposed thereon was formed using technical grade pentaerythritol and 3,5,5-trimethyl hexanoic acid (Sample 10) by mixing about 225% molar equivalents of 3,5,5-trimethyl hexanoic acid with each mole of technical grade pentaerythritol. This was compared in Table 7 below with a conventional polyol ester formed from technical grade pentaerythritol and 3,5,5-trimethyl hexanoic acid (Sample 9) prepared using an excess of 3,5,5-trimethyl hexanoic acid.

TABLE 7

| Sample Number | Ester | HPDSC Decomposition Time, Min. |
|---|---|---|
| 9 | TechPE/TMH | 148 |
| 10 | TechPE/TMH w/25% Unconverted OH | 468 |

TechPE is technical grade pentaerythritol (i.e., about 88% mono-, 10% di- and 1–2% tri-pentaerythritol).
TMH is 3,5,5-trimethyl hexanoic acid.

The data set forth above in Tables 6 and 7 support the discovery by the present inventors that certain compositions of polyol esters which contain at least 5 mole % unconverted hydroxyl (OH) groups have surprisingly enhanced thermal/oxidative stability as measured by high pressure differential scanning calorimetry (HPDSC) versus conventional polyol and non-polyol esters.

EXAMPLE 5

Certain polyol esters containing at least 5 mole % unconverted hydroxyl groups show dramatic enhancements in thermal/oxidative performance in the HPDSC test when compared to polyol esters of trimethylol propane and a linear acid (7810). These esters contain specific types of branching and the enhancement is seen for both trimethylol propane (TMP), and pentaerythritol (both mono grade and technical grade) esters. Table 8 below summarizes the results.

TABLE 8

| Sample Number | Ester | Hydroxyl No. | HPDSC Decomposition Time, Min. |
|---|---|---|---|
| 1 | TMP/2EH | 20 | 30.1 |
| 2 | TMP/2EH | 64.0 | 225.3 |
| 3 | TMP/2EH | 75.0 | 125.3 |
| 4 | MPE/2EH | 12.1 | 24.4 |
| 5 | MPE/2EH | 63.8 | 183.5 |
| 6 | TechPE/2EH | 3.6 | 17.5 |
| 7 | TechPE/TMH | <10 | 148 |
| 8 | TechPE/TMH | 86 | 268 |
| 9 | TechPE/TMH | 68.5 | 364 |
| 10 | TechPE/TMH | >50 | 468 |
| 11 | TMP/7810 | 0.2 | 26.1 |
| 12 | TMP/7810 | 25.7 | 21.3 |
| 13 | TMP/7810 | 26.8 | 22.9 |
| 14 | TMP/7810 | 43.5 | 21.3 |
| 15 | TMP/7810 | 73.8 | 26.5 |

Hydroxyl Number is measured in mg KOH/gram sample using a conventional near infrared technique.
2EH is 2-ethyl hexanoic acid.
TechPE is technical grade pentaerythritol (i.e., 88% mono-, 10% di- and 1–2% tri-pentaerythritol).
MPE is mono-pentaerythritol.
TMH is 3,5,5-trimethyl hexanoic acid.
TMP is trimethylol propane.
7810 is a blend of 37 mole % of a n-$C_7$ acid and 63 mole % of a mixture of 3–5 mole % n-$C_6$ acid, 48–58 mole % n-$C_8$ acid, 36–42 mole % n-$C_{10}$ acid, and 0.5–1.0 mole % n-$C_{12}$ acid.

The results set forth above in Table 8 demonstrate that when all of the initially added antioxidant (Vanlube®-81) is consumed, the ester radicals are not healed and true decomposition occurs rapidly as shown in sample numbers 1, 4 and 6 which have small amounts of unconverted hydroxyl groups, as well in the polyol esters formed from linear acids regardless of amount of unconverted hydroxyl groups present (see samples numbers 11–15). With certain branched esters such as sample numbers 2, 3, and 6–10 above, the unconverted hydroxyl group (i.e., the only molecular change from the full ester) is capable of transferring its hydrogen to the first formed radical so as to created a more stable radical, thereby acting as an additional antioxidant. With the linear acid esters set forth above in sample numbers 11–15, the internal radical generated from transfer of a hydrogen from an unconverted hydroxyl group is not significantly more stable than the initially formed carbon radical, thereby yielding essentially no change in decomposition time.

EXAMPLE 6

The data set forth below in Table 9 demonstrate that polyol ester compositions having unconverted hydroxyl groups which are formed from polyols and branched acids in accordance with the present invention exhibit internal antioxidant properties.

TABLE 9

| Sample Number | Ester | Hydroxyl Number | HPDSC Decomposition Time, Min. |
|---|---|---|---|
| 1 | TechPE/TMH | greater than 50 | 468 with 0.5% V-81 |
| 2 | TechPE/TMH | greater than 50 | 58.3 with no V-81 |
| 3 | TechPE/L9 | less than 5 | 16.9 with 0.5% V-81 |
| 4 | Tech PE/TMH | less than 5 | 148 with 0.5% V-81 |
| 5 | Tech PE/TMH | less than 5 | 3.14 with no V-81 |

V-81 is dioctyl diphenyl amine.
TechPE is technical grade pentaerythritol (i.e., 88% mono-, 10% di- and 1–2% tri-pentaerythritol).
TMH is 3,5,5-trimethyl hexanoic acid.
L9 is blend of 62–70 mole % linear $C_9$ acid and 30–38 mole % branched $C_9$ acid.

The results in Table 9 above demonstrate that polyol esters with unconverted hydroxyl groups (i.e., sample numbers 1 and 2) greatly enhance the oxidative induction time of the lubricant formulation versus conventional polyol esters which do not have any significant mount of free or unconverted hydroxyl groups. Moreover, combining these unique polyol esters with an antioxidant such as V-81 significantly extends the time required for decomposition (see sample no. 1). Although the time for decomposition was reduced when this polyol ester did not include any added antioxidant, it still took approximately 3½ times longer to decompose versus a conventional $C_9$ acid polyol ester which had an antioxidant additive (i.e., 58.3 minutes (sample 2) versus 16.9 minutes (sample 3)). Furthermore, Samples 4 and 5 demonstrate that decomposition of the polyol ester compositions having a hydroxyl number less than 5 occurs much more rapidly compared to polyol ester compositions of the same acid and polyol having a hydroxyl number greater than 50 (e.g., Samples 1 and 2) regardless of whether or not an antioxidant is admixed with the respective polyol ester composition. This clearly demonstrates that synthesizing a polyol ester composition having unconverted hydroxyl groups disposed about the carbon chain of the polyol ester provide enhanced thermal/oxidative stability to the resultant product, as measured by HPDSC. Finally, a comparison of Sample Nos. 2 and 5, wherein no antioxidant was used, clearly establishes the antioxidant properties of the polyol ester of technical grade pentaerythritol and 3,5,5-trimethyl hexanoic acid having substantial amounts of unconverted hydroxyl groups bonded thereto. That is, the sample with unconverted hydroxyl groups exhibited an HPDSC of 58.3 minutes versus the same polyol ester with little or no unconverted hydroxyl groups which exhibited an HPDSC of 3.14 minutes.

What is claimed is:

1. A lubricant for internal combustion engines fueled by hydrocarbons, said lubricant comprising:

a base stock which comprises at least one synthetic ester having between 5–50% unconverted hydroxyl groups, based on the total amount of hydroxyl groups in said synthetic ester, and an oxygen, nitrogen or halogen content of at least 15 wt. %, based on the total weight of said base stock; and an additive package; wherein the solubility of said hydrocarbon is less than 5% at 1 bar.

2. The lubricant according to claim 1 wherein said base stock has an oxygen, nitrogen and/or halogen content in the range of about 16 to 30 wt. %, based on the total weight of said base stock.

3. The lubricant according to claim 1 wherein said synthetic ester has 5–35% unconverted hydroxyl groups and is formed from the reaction product of: a branched or linear alcohol having the general formula $R(OH)_n$, wherein R is an aliphatic or cyclo-aliphatic group having from about 2 to 20 carbon atoms and n is at least 2, and at least one branched mono-carboxylic acid which has a carbon number in the range between about $C_5$ to $C_{13}$; wherein said synthetic ester composition has between 5–35% unconverted hydroxyl groups, based on the total amount of hydroxyl groups in said branched or linear alcohol.

4. The lubricant according to claim 1 wherein said synthetic ester is a polyol ester.

5. The lubricant according to claim 1 wherein said base stock has a metals content of less than 10 ppm.

6. The lubricant according to claim 1 wherein said base stock has a total acid number of less than 0.05 milligrams KOH per gram of said base stock.

7. The lubricant according to claim 1 wherein said additive package comprises at least one additive selected from the group consisting of: ashless dispersants, metal detergents, corrosion inhibitors, metal dihydrocarbyl dithiophosphates, anti-oxidants, pour point depressants, anti-foaming agents, anti-wear agents, friction modifiers, and viscosity modifiers.

8. The lubricant according to claim 1 wherein said base stock is blended with at least one additional base stock selected from the group consisting of: mineral oils, highly refined mineral oils, poly alpha olefins, polybutenes, polyalkylene glycols, phosphate esters, silicone oils, diesters, polyisobutylenes, ethylene/butene copolymers, and other polyol esters.

* * * * *